US005255412A

United States Patent [19]

Mally et al.

[11] Patent Number: 5,255,412

[45] Date of Patent: Oct. 26, 1993

[54] AIR AMPLIFIED MINI-VACUUM

[76] Inventors: Sujith N. V. Mally, 33353A 1st Pl. S., Federal Way, Wash. 98003; David W. Sharpe, 712 220th SW., Bothell, Wash. 98021; Jeffrey L. Colehour, 4760 130th Ave. SE., Bellevue, Wash. 98006

[21] Appl. No.: 669,263

[22] Filed: Mar. 14, 1991

[51] Int. Cl.[5] ..... A47L 5/18

[52] U.S. Cl. ..... 15/409; 417/151

[58] Field of Search ..... 15/409; 417/151

[56] References Cited

U.S. PATENT DOCUMENTS

| | | | |
|---|---|---|---|
| 451,387 | 4/1991 | Baldwin | 15/409 |
| 503,559 | 8/1993 | Thompson | 15/409 |
| 2,475,832 | 7/1949 | Gilliland | 15/409 X |
| 2,634,902 | 4/1953 | Brown | 417/198 |
| 2,688,835 | 9/1954 | Rawson | 15/409 X |
| 2,851,213 | 12/1951 | Swallert | 15/409 |
| 2,856,205 | 10/1958 | Coleman et al. | 417/181 |
| 3,655,298 | 4/1972 | Baker | 417/196 |
| 3,885,891 | 5/1975 | Throndson | 417/196 |
| 3,922,753 | 12/1975 | Aberilla | 15/409 |
| 4,379,679 | 4/1983 | Guile | 417/196 |
| 4,736,489 | 4/1988 | Egan | 15/409 |
| 4,799,863 | 1/1989 | Gannon | 417/181 |

FOREIGN PATENT DOCUMENTS

| | | | |
|---|---|---|---|
| 1253621 | 8/1986 | U.S.S.R. | 15/409 |

*Primary Examiner*—Chris K. Moore

[57] ABSTRACT

An air pressure powered vacuum has a housing with a continuous channel through it. Positive pressure air is introduced into and accelerates in an annular shaped plenum in the housing. The high velocity air is diffused from the plenum into the channel towards a debris collection bag. The diffuser is shaped so that the air diffuses at an angle with respect to the surface of the channel and such that laminar air flow occurs adjacent said channel wall downstream. This creates strong suction at the channel inlet and debris is carried to the collection bag.

2 Claims, 3 Drawing Sheets

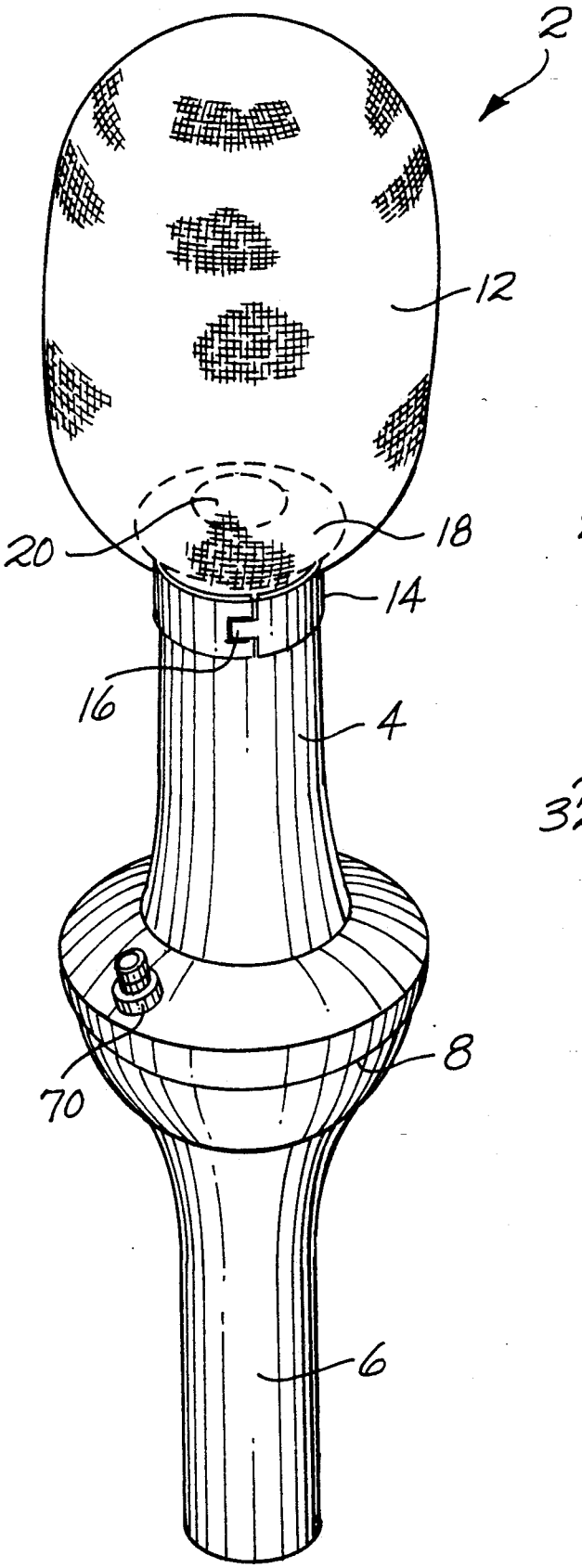
Fig. 1
Fig. 2
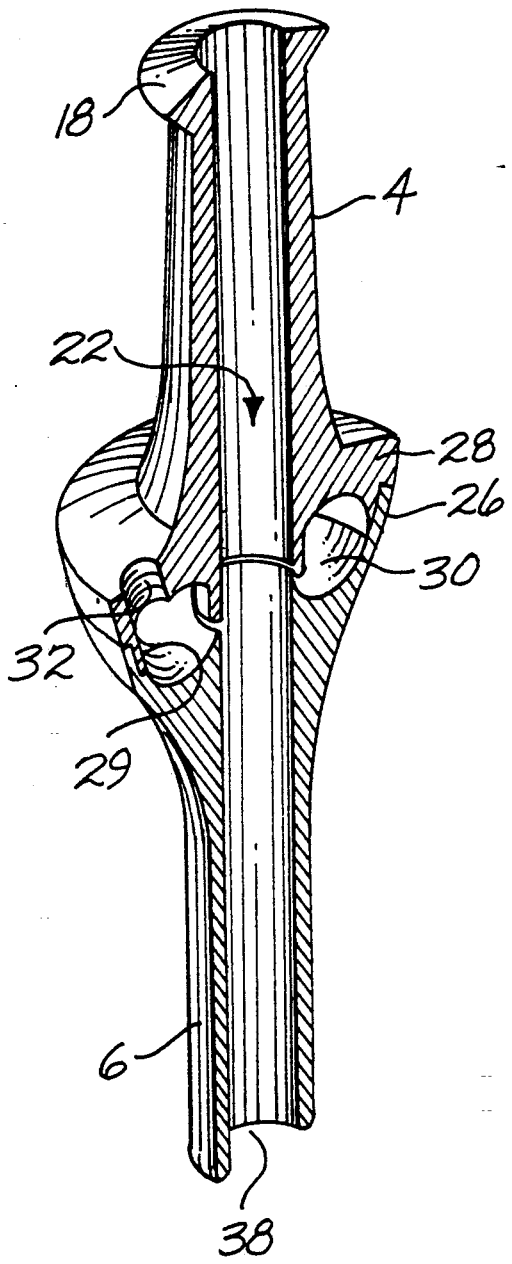

AIR AMPLIFIED MINI-VACUUM

This invention relates to an improved, light weight, air powered mini-vacuum particularly useful in shop situations. More particularly, the invention relates to a more efficient and quiet mini-vacuum that is powered with compressed air.

BACKGROUND

In the assembly of commercial aircraft, a substantial amount of small debris is created which drops onto the decking or inner skin. This debris is routinely removed, generally with the assistance of a mini-vacuum, i.e., a small, impeller powered, hand-held vacuum. The performance of available commercial mini-vacuums has been found to be less than desired. None that we know of has sufficient suction to efficiently remove debris. All of the units are noisy, and all have working parts which tend to wear out too frequently.

Accordingly, this invention was made to provide an improved mini-vacuum which performs better, lasts longer and costs less.

BRIEF SUMMARY

In accordance with a preferred embodiment of the invention an improved mini-vacuum is provided which is powered by positive pressure air. It comprises a housing which has a hollow, cylindrical channel. An annular-shaped plenum is located in the housing surrounding the channel. Positive pressure air, such as compressed shop air, is introduced into the plenum. A ring-shaped nozzle from the plenum to the channel directs the high velocity air towards the channel outlet at a small angle with respect to the channel surface. Downstream of the nozzle, the air adheres to the walls of the channel and mixes with the ambient channel air towards the outlet end. This creates a vacuum at the inlet end of the channel. Waste is drawn through the inlet by the vacuum and carried into the collector bag on the positive pressure air.

There are no moving parts nor any interference such as sharp bends, or protuberances in the debris flow path. Accordingly, this novel mini-vacuum is less subject to wear and clogging. Moreover, the acceleration of the air supply in the plenum and the Coanda effect created by its flow through the nozzle increases vacuum with respect to impeller powered units. We have also found the subject mini-vacuums to be more quiet than commercially available models.

The invention will be better understood in view of the Figures and the following detailed description of the invention.

DETAILED DESCRIPTION

FIG. 1 is a perspective view of a mini-vacuum in accordance with the invention.

FIG. 2 is a sectional perspective view of the mini-vacuum of FIG. 1 without the collector bag.

Figure 3:
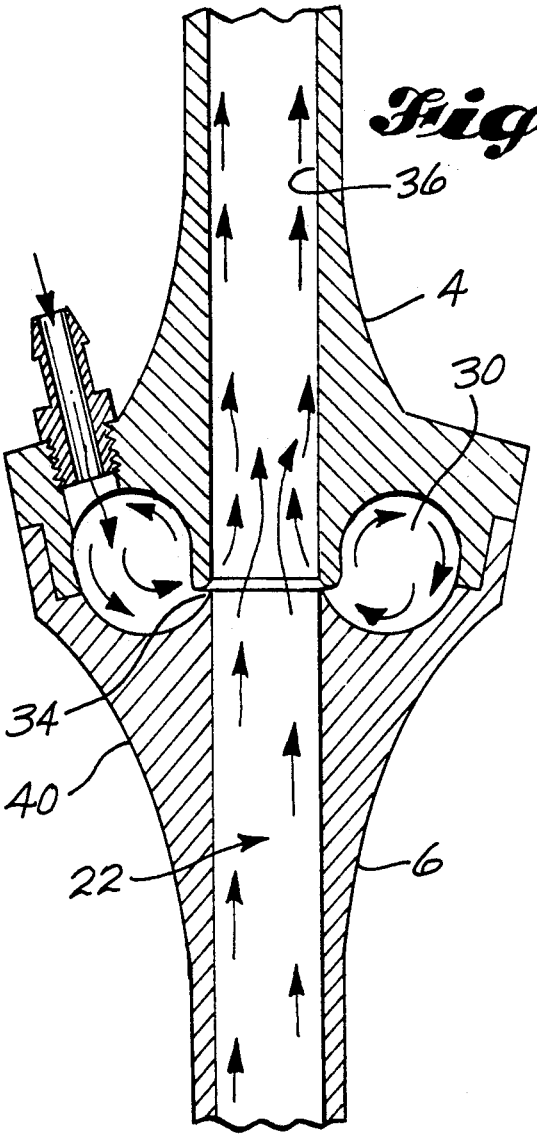
FIG. 3 is a side sectional view of a portion of the mini-vacuum, airflow paths being indicated by the arrows.

Referring to FIG. 1 mini-vacuum 2 comprises a mixer tube 4 and nozzle tube 6. Mixer tube 4 and nozzle tube 6 meet at parting line 8. A male quick disconnect 10 for a positive pressure air source (not shown) is threaded into inlet 32 in mixer tube 4. An air-permeable coarse-weave collector bag 12 is secured to mixer tube 4 by attached collar 14 and clasp 16. The collar fits snugly around mixer tube 4 and is secured in position by bag flange 18. Debris picked up by mini-vacuum 2 is deposited in bag 12 after it passes through mixer tube outlet 20.

FIG. 2 shows a cross sectional perspective view of mixer tube 4 and nozzle tube 6. Air and debris flow through mini-vacuum 2 is through nozzle channel 22 in nozzle tube 6 and mixer channel 24 in mixer tube 4. Flange 26 mates with mixer nozzle inset 28 so that nozzle and mixer tubes fit snugly together at mating line 29 by an air-tight press fit. Key to the invention is the annular-shaped plenum 30 from which positive pressure air exits through specially adapted nozzle 34. Plenum 30 is formed between mixer tube 4 and nozzle tube 6.

Figure 4:
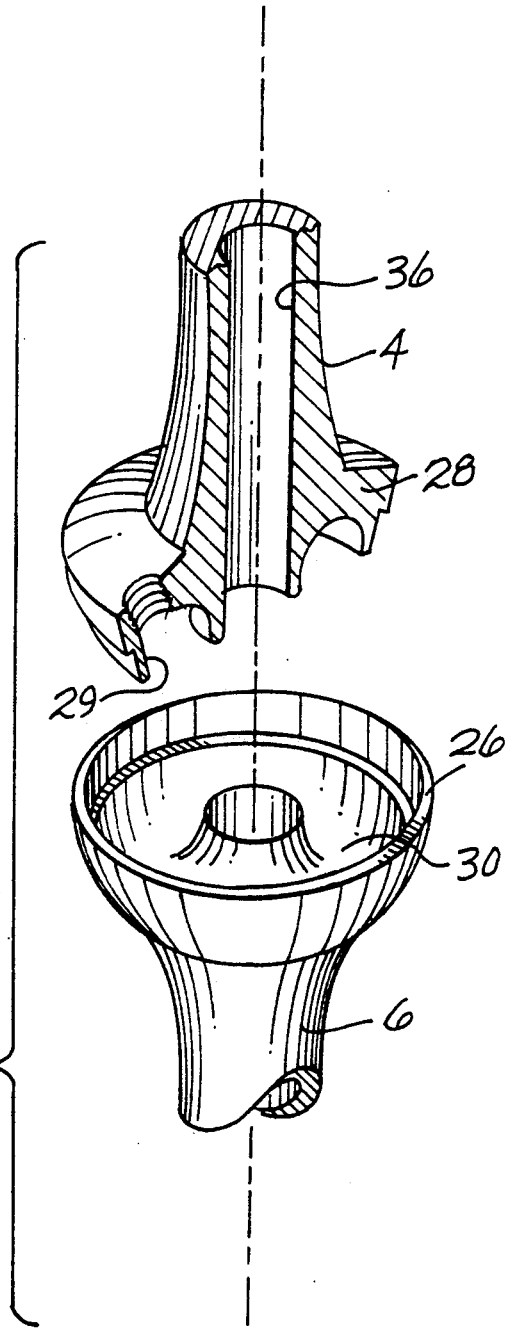
FIG. 4 is an exploded sectional view of a portion of the top and bottom segments of a mini-vacuum in accordance with the invention. The top portion is shown in cross section.

Operation of mini-vacuum 2 by the inlet of pressurized air through quick disconnect 10 will be better understood in view of FIGS. 3 and 4. The male disconnect is screwed into threaded inlet 32 and a female quick disconnect with attached positive pressure air hose is attached. This causes air to travel through the channel in disconnect 10 and enter annular plenum 30. Plenum 30 is shaped so that the air follows a rotating path as indicated by the arrows. This increases the velocity of the air which exits into mixer tube 4 through annular nozzle 34. Plenum 30 and nozzle 34 are shaped to cause the high velocity air to exit into the channel formed by mixer tube 4 and nozzle tube 6 at an acute angle with respect to mixer wall 36. An angle of zero degrees relative to the channel wall is desirable but larger angles are acceptable. The angle may be calculated by one skilled in the art to be such that the Coanda effect occurs. The angle must be small enough that surface tension between mixer wall 36 and the high velocity air is enough to cause the flow to adhere to the wall 36 downstream of nozzle 34 while mixing with ambient flow in the mixer tube 4. The presence of mixing region 40 creates a vacuum in nozzle channel 22. This draws debris into nozzle inlet 38 through channel 22 and into debris bag 12. We have found that the life of bag 12 can be extended by incorporating a baffle downstream from the channel outlet to prevent sharp debris from puncturing it.

Mixer channel 4 and nozzle channel 6 fit together so that a channel with a substantially smooth continuous wall is formed. Unlike conventional mini-vacuums, there is no blockage in the channel to debris flow to the collector bag. We have found that a constant cross-section channel is acceptable, but the shape and size of the channel may be varied along its length without departing from the invention referring to FIG. 5, a monolithic mini-vacuum body 50 may be molded in a single piece using an expendable core (not show) to create channel 52 and nozzle 54.

SPECIFIC EXAMPLE

A mini-vacuum was machined from aluminum. It had a nozzle tube length of approximately 5 inches and a channel diameter of 0.75 inches. The mixer tube had a like length and diameter. The annular plenum had a radius of approximately 0.4 inches and air was outleted through the diffuser at an angle of approximately 6° with respect to the mixer tube wall. A large porous collection bag was attached at the mixer tube outlet.

A quick-disconnect nozzle with a cross sectional flow area of approximately 0.12 sq. inches was screwed into the mixer tube. A ⅜ inch shop air supply hose was attached to the quick disconnect, nominal shop air pressure being optimally about 90 psi. The mini-vacuum will work at substantially lower or higher pressures.

Referring to the Table, the subject mini-vacuum was compared to four commercially available mini-vacuums. The subject invention had at least twice the suction of any of the commercial models and the measured noise was less, eliminating the need for ear protection in some circumstances. The prototype described in the above example was built based on a modeling program used in jet engine design. Based on the results of that modeling, a preferred length for the mixer tube and nozzle tube section is in the range of about 3 to 7 inches each. The preferred diameter of the nozzle and mixer channels is in the range of about 0.5 to 1.5 inches and the preferred annular nozzle area would be in the range of about 0.02 to 0.06 square inches. Constriction of the air flow from the larger cross section, positive air pressure supply into the plenum as it exits through the smaller cross section nozzle results in a pressure drop and velocity increase. The angle at which the accelerated air exits the nozzle is preferably in the range of from about zero to 10° with respect to the mixer channel wall. Such angles allow flow from the nozzle to pass along the channel wall resulting in improved suction at the channel inlet. Because the mini-vacuum is so powerful, it is preferred to make the collector bag out of tough, wear-resistant fibers such as Kevlar TM or fiberglass.

Figure 5:
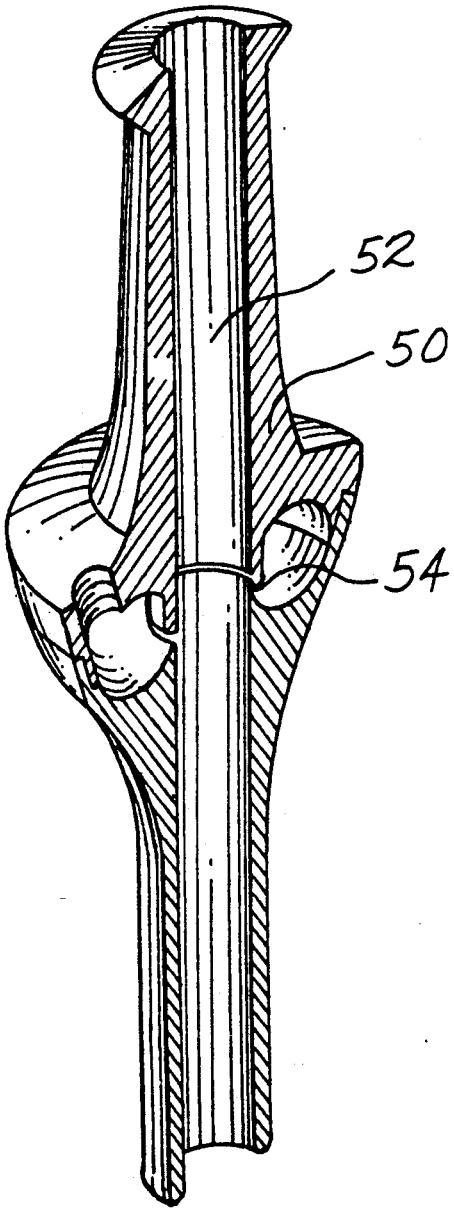
FIG. 5 is a side sectional view of a monolithic mini-vacuum without the collector bag.

The design of the subject mini-vacuums lend themselves to manufacture by injection molding suitable polymeric materials such as nylon or Delrin TM. The channel housing may also be molded in a single piece 52 as seen in FIG. 5.

Clear advantages of the subject design are more than twice as much suction as currently available models and lower noise. The cost of the subject vacuums is expected to be lower and they weigh less than existing models. There are no moving parts to wear out which results in further cost savings. Cost savings may also be realized by the reduced time needed to clear up debris.

While our invention has been described in terms of specific embodiments thereof, other forms may be readily adapted by one skilled in the art.

We claim:

1. A mini-vacuum comprising a monolithic housing; a cylindrical channel in said housing, said channel having an inlet at one end through which a vacuum is drawn and an outlet at the other end through which waste is carried on a positive pressure flow stream and which channel has a substantially smooth continuous cross section without protuberances into said flow stream; an annular plenum in said housing surrounding said channel; an inlet to said plenum through which positive pressure air is introduced and circulated within said plenum; a nozzle from said plenum which directs positive pressure air therefrom into said channel toward said channel outlet at an angle with respect to the surface of said channel such that said air adheres to the said channel surface downstream of said nozzle creating a vacuum at said channel inlet; and an air porous collection bag at said channel outlet.

2. An air pressure powered vacuum comprising a monolithic housing; a channel in said housing, said channel having an inlet at one end through which a vacuum is drawn and an outlet at the other end through which waste is carried on a positive pressure flow stream and which channel has a substantially smooth continuous cross section without protuberances into said flow stream; an annular plenum in said housing surrounding said channel; an inlet to said plenum through which positive pressure air is introduced and circulated within said plenum; a nozzle from said plenum which directs positive pressure air therefrom into said channel toward said channel outlet at an angle with respect to the surface of said channel inlet; and an air porous collection bag at said channel outlet.

* * * * *